US005791154A

United States Patent [19]

Schulak

[11] Patent Number: 5,791,154

[45] Date of Patent: Aug. 11, 1998

[54] ENERGY TRANSFER SYSTEM FOR REFRIGERATION COMPONENTS

[76] Inventor: Edward R. Schulak, 567 Aspen, Birmingham, Mich. 48009

[21] Appl. No.: 702,029

[22] Filed: Aug. 23, 1996

Related U.S. Application Data

[60] Continuation-in-part of Ser. No. 485,468, Jun. 7, 1995, which is a division of Ser. No. 179,974, Jan. 11, 1994, Pat. No. 5,520,007, which is a continuation of Ser. No. 995,980, Dec. 13, 1992, Pat. No. 5,291,749.

[51] Int. Cl.[6] ..... F25D 17/04

[52] U.S. Cl. ..... 62/186; 62/428; 62/441

[58] Field of Search ..... 62/404, 405, 406, 62/426, 428, 440, 441, 89, 255, 238.1, 238.6, 238.7, 186, 183

[56] References Cited

U.S. PATENT DOCUMENTS

| | | | |
|---|---|---|---|
| 1,769,119 | 7/1930 | Davenport . | |
| 2,234,753 | 3/1941 | Frazer . | |
| 2,249,772 | 7/1941 | Maniscalco . | |
| 2,362,729 | 11/1944 | Smith . | |
| 2,517,686 | 8/1950 | Larkin . | |
| 2,579,056 | 12/1951 | Thompson . | |
| 2,655,795 | 10/1953 | Dyer . | |
| 3,017,162 | 1/1962 | Haines et al. . | |
| 3,123,986 | 3/1964 | Lukas et al. . | |
| 3,248,895 | 5/1966 | Mauer . | |
| 3,370,438 | 2/1968 | Hopkinson . | |
| 3,478,533 | 11/1969 | Kocher et al. . | |
| 3,500,655 | 3/1970 | Lyons . | |
| 3,785,168 | 1/1974 | Domingorene . | |
| 3,905,202 | 9/1975 | Taft et al. . | |
| 4,008,579 | 2/1977 | Horvay . | |
| 4,068,494 | 1/1978 | Kramer . | |
| 4,136,528 | 1/1979 | Vogel et al. . | |
| 4,210,000 | 7/1980 | Lee . | |
| 4,220,011 | 9/1980 | Berman et al. . | |
| 4,245,481 | 1/1981 | McDermott . | |
| 4,365,983 | 12/1982 | Abraham et al. . | |
| 4,437,317 | 3/1984 | Ibrahim . | |
| 4,474,022 | 10/1984 | Puskar . | |
| 4,735,059 | 4/1988 | O'Neal . | |
| 4,815,298 | 3/1989 | Vam Steenburgh, Jr. . | |
| 5,050,398 | 9/1991 | Lane et al. . | |
| 5,070,705 | 12/1991 | Goodson et al. . | |
| 5,081,850 | 1/1992 | Wakatsuki et al. . | |
| 5,144,816 | 9/1992 | Chase . | |
| 5,228,313 | 7/1993 | Okamoto et al. | 62/440 |
| 5,291,749 | 3/1994 | Schulak . | |
| 5,347,827 | 9/1994 | Rudick et al. | 62/440 |
| 5,402,651 | 4/1995 | Schulak . | |
| 5,520,007 | 5/1996 | Schulak . | |

FOREIGN PATENT DOCUMENTS

| | | |
|---|---|---|
| 2189693 | 1/1974 | France . |
| 17 79 653 B2 | 1/1978 | Germany . |
| 41 14 915 A1 | 11/1992 | Germany . |
| 43 00 750 A1 | 5/1993 | Germany . |
| 1508722 | 4/1978 | United Kingdom . |
| WO 94/15158 | 7/1994 | WIPO . |
| WO 95/16887 | 6/1995 | WIPO . |

*Primary Examiner*—John M. Sollecito
*Attorney, Agent, or Firm*—Harness, Dickey & Pierce, P.L.C.

[57] ABSTRACT

An energy transfer system for a household refrigeration appliance. The energy transfer system includes a compartment for enclosing a condenser which is associated with the refrigeration appliance, and a set of conduits for enabling the transfer of outside air into, through, and out of the compartment. The system also includes a movable barrier for selectively controlling the transfer of air through the compartment. In one form of the present invention, the system also includes a thermostatically actuated fan for forcing outside air into, through, and out of the compartment in response to a predetermined temperature.

2 Claims, 3 Drawing Sheets

ENERGY TRANSFER SYSTEM FOR REFRIGERATION COMPONENTS

CROSS-REFERENCE TO RELATED APPLICATIONS

This application is a continuation-in-part of U.S. application Ser. No. 08/485,468 filed Jun. 7, 1995; which is a divisional of application Ser. No. 08/179,974 filed Jan. 11, 1994, now U.S. Pat. No. 5,520,007; which is a continuation of application Ser. No. 07/995,980 filed Dec. 13, 1992, now U.S. Pat. No. 5,291,749.

BACKGROUND OF THE INVENTION

The present invention generally relates to domestic refrigerators and freezers. More particularly, the present invention relates to a system and method for utilizing cool outdoor ambient temperature levels to reduce the energy required to operate a domestic refrigerator or freezer system.

Virtually every home and apartment in this country has at least one refrigerator for storing perishable food products. Additionally, many households also have a freezer for storing food products over extended periods of time. As a consequence of such widespread usage, these domestic appliances consume a substantial part of the electrical energy which is generated by the nation's utility companies. In this regard, it should be noted that despite recent strides, refrigerators are still only half as efficient as the theoretical limit, the Reverse Carnot Cycle. Consequently, a substantial opportunity still exists to increase the energy efficiency of domestic refrigeration appliances. Since even the newest refrigerators consume approximately 700 kwh of electricity per year, it should be understood that a substantial need still exists to increase the energy efficiency of domestic refrigeration appliances.

Accordingly, it is a principal objective of the present invention to provide a system and method which reduces the energy required to operate domestic refrigerator and freezer systems.

It is another objective of the present invention to provide an energy efficient domestic refrigeration system which minimizes the heat generated inside a home when the desired indoor temperature exceeds the outdoor ambient temperature.

It is a further objective of the present invention to provide a domestic refrigeration system which may be applied to retrofit existing domestic refrigeration units or applied at the factory to new domestic refrigeration units.

SUMMARY OF THE INVENTION

To achieve the foregoing objectives, the present invention provides an energy transfer system for a household refrigeration appliance. The energy transfer system includes a compartment for enclosing the condenser and compressor which are associated with the refrigerator, and a set of conduits for enabling the transfer of outside air into, through, and out of the compartment. The system also includes a movable barrier for selectively controlling the transfer of air through the compartment. In one form of the present invention, the system also includes a thermostatically actuated fan for forcing outside air into, through, and out of the compartment in response to a predetermined temperature.

The set of conduits preferably includes a first conduit for enabling the transfer of outside air to the compartment, and a second conduit for enabling the transfer of air from the compartment to the outside environment. Each of these conduits are disposed such that they extend through an external wall of said household. To facilitate the convection flow of air, the outlet of one conduit is connected to the compartment at a location which is lower than an inlet connection of the other conduit.

Additional features and advantages of the present invention will become more fully apparent from a reading of the detailed description of the preferred embodiment and the accompanying drawings in which:

DETAILED DESCRIPTION OF THE PREFERRED EMBODIMENTS

Figure 1:
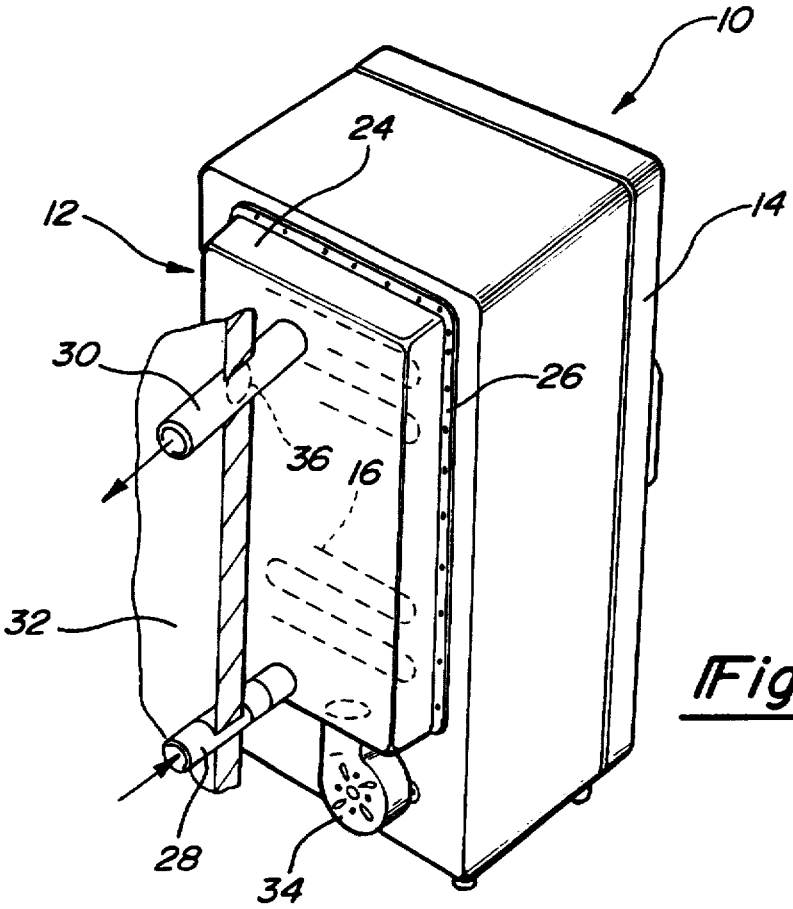
FIG. 1 is a perspective view of a household refrigeration appliance in accordance with the present invention.

Referring to FIG. 1, a perspective view of a household refrigeration appliance 10 in accordance with the present invention is shown. More specifically, the household refrigeration appliance depicted in FIG. 1 is a domestic refrigerator which has been retro-fitted with the energy transfer system 12 in accordance with the present invention. However, it should be understood that the principles of the present inventions are equally applicable to a domestic refrigerator which has been constructed at the originating factory to include a built-in energy transfer system. Additionally, it should be appreciated that the present invention is directed at household refrigeration appliances, such as self-contained refrigerators and freezers, that are specifically adapted for use in a home environment. In this regard, it should be understood that a completely different set of constraints and design criteria may be employed with commercial refrigeration equipment, which have a compressor and refrigerator cabinet in separate locations.

Figure 3:
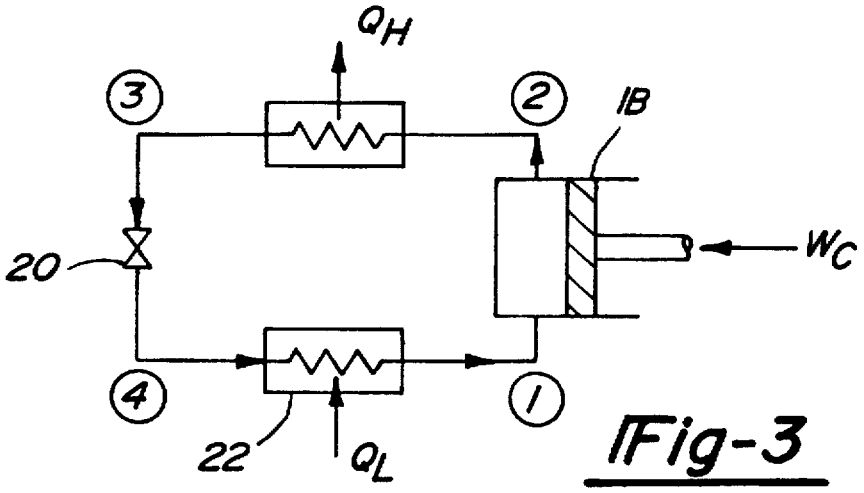
FIG. 3 is a schematic representation of a refrigeration system.

As shown in FIG. 1, the refrigerator 10 generally includes at least one door 14 across its front and a serpentine tube condenser 16 mounted across its back. As well known in the field, the condenser 16 is connected to the discharge end of a pump to condense a refrigerant fluid, such as freon, from a gaseous phase to a liquid phase. This process creates heat which must be removed in order for the refrigeration cycle to work. In this regard, FIG. 3 shows a schematic diagram of a conventional refrigeration cycle, with the pump indicated by reference numeral 18. An expansion device 20 is used to permit the compressed refrigerant to expand in an evaporator coil 22, which is disposed within the interior of the refrigerator 10. This process of expansion operates to remove heat from the interior of the refrigerator 10.

With this household refrigerator arrangement, the heat produced at the condenser 16 is simply released into the area of the home which surrounds the refrigerator. However, in accordance with the present invention, a compartment 24 is used to enclose the condenser 16. As shown in FIG. 1, the compartment 24 may be comprised of a five-sided molded fiberglass shell which is mounted to the exterior side of the refrigerator 19 where the condenser 16 is located. In this regard, the compartment 24 includes a flange 26 which extends around its periphery in order to enable the compartment to be secured to the refrigerator 10 over the condenser 16, such as with a plurality of spaced screws. However, it should be understood that the compartment may be comprised of other suitable materials and may take other suitable shapes in the appropriate application. For example, with a factory built-in energy transfer system, the compartment 24 may be formed integrally with a side of the refrigerator 10, such that the consumer need not discern that the compartment is included as part of the refrigerator body. Additionally, the compartment 24 may be constructed such that it includes an insulative layer in order to more fully control the transfer of heat from the condenser 16.

Figure 2:
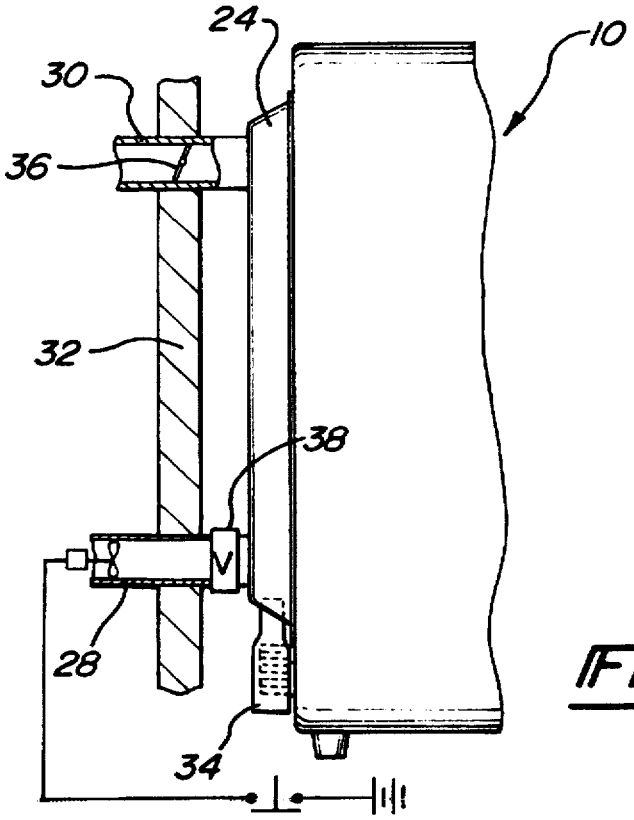
FIG. 2 is a side elevation view of the refrigerator shown in FIG. 1.

The energy transfer system 12 also includes one or more passageways for enabling the transfer of heat out of the compartment 24 and for selectively utilizing outside air in this process. Thus, for example, as shown in FIGS. 1 and 2, the energy transfer system 12 includes a first conduit 28 which enables cool air from outside of the home to enter the compartment 24, and a second conduit 30 which enables air from inside the compartment to be released outside of the home. In this regard, both of these figures show an exterior wall 32 of the household wall, and the conduits 28 and 30 are constructed such that they are able to extend through this exterior wall. The conduits 28 and 30 may be made of any suitable material which is appropriate for this purpose (e.g., sheet metal or flexible insulated duct), and the conduits may be connected to the compartment in a variety of ways.

It should also be noted that the first conduit 28 is connected to the compartment 24 at a location which is lower than that where the second conduit 30 is connected to the compartment. This arrangement is used to facilitate outside air passing through the first conduit 28 into the compartment, through the compartment and out of the second conduit 30 by heat convection. While the conduits 28–30 are shown to be relatively straight pipes or tubes, it should be understood that other suitable shapes may be employed, depending upon such considerations as the available space and the distance between the refrigerator 10 and the exterior wall 32.

FIGS. 1 and 2 also show the provision of a fan 34 or, 35, respectively, which may be used to force the flow of outside air into, through, and out of the compartment 24. While the fan 34 is shown to be connected to the compartment 24 in a way which is separate than the connection of the conduits 28–30 to the compartment, it is preferred that the fan be connected in-line with the first conduit 28, such as fan 35, either within the conduit or adjacent to its outlet into the compartment. Additionally, it is preferred that the fan 34 or 35 be a thermostatically actuated fan, so that its use may be carefully controlled to achieve the most energy efficient benefit.

Additionally, as shown in FIGS. 1 and 2, the energy transfer system 12 also includes a movable barrier or wall in one or both of the conduits 28–30 to control the flow of air through the compartment 24. In one form of the present invention, this movable barrier is comprised of a butterfly valve 36 which may be used to prevent or enable the flow of outside air into the compartment via a butterfly valve disposed in one or both of the conduits 28–30. For example, in the case of butterfly valve 36 disposed in the second conduit 30, the flow of outside air through the first conduit 28 could provide sufficient force to open the butterfly valve, and thereby permit the escape of air from the compartment 24 through the second conduit.

From the above, it should be understood that the energy transfer system 12 allows energy in the form of hot condenser air, to transfer to the cool outdoors, rather than to the warmer indoor ambient. In other words, the present invention provides for a more efficient energy transfer from the refrigeration components to the outside environment, instead of having to transfer these components to the outside. By rejecting heat to a lower temperature reservoir, the condenser will operate at a reduced temperature, and the work of compression will decrease accordingly. Consequently, the overall energy efficiency of the refrigerator will increase.

Figure 4:
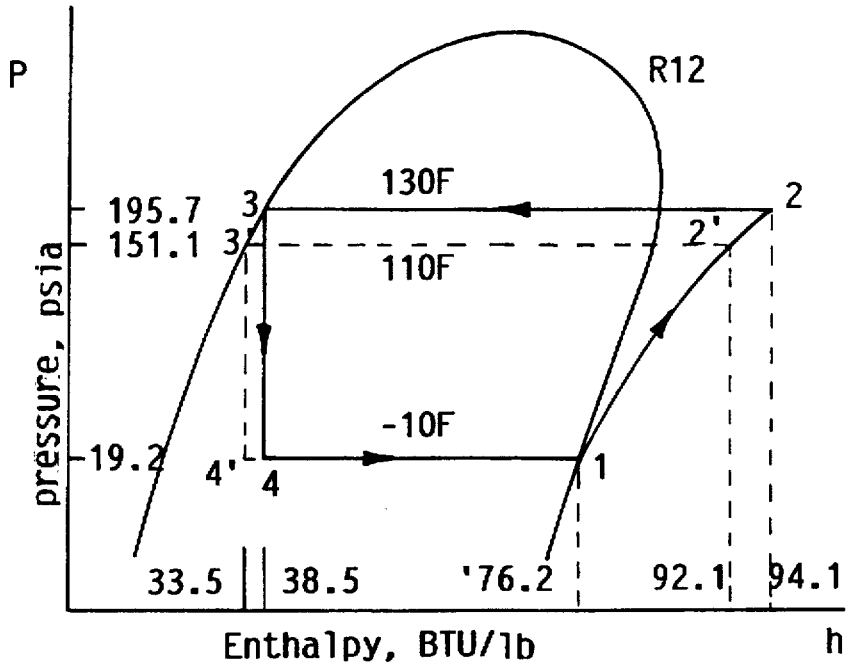
FIG. 4 is a graph of the vapor-compression refrigeration cycle for the refrigeration system of FIG. 3.

FIG. 3 is a schematic diagram of the refrigeration system, while FIG. 4 shows the "Basic" or "Standard" refrigeration cycle on the pressure-enthalpy (p-h) plot of Refrigerant 12. The process 1-2 represents the work of compression, 2-3 condensation, 3-4 expansion, and 4-1 evaporation, i.e. the refrigeration effect. If this Basic refrigerator operates in 90° F. indoor ambient temperature, between 195.7 psia condenser pressure and 19.2 psia evaporator pressure (corresponding to 130° F. condenser temperature and −10° F. evaporator temperature, i.e. "Standard Conditions") then the work of compression and the refrigeration effect, in terms of enthalpies, will be $W_c=h_2-h_1=94.1-76.2=17.9$ BTU/lb $Q_i=h_1-h_4=76.2-38.5=37.7$ BTU/lb If by venting of outside air the condenser temperature is lowered from 130° F. to 110° F. the work of compression and the refrigeration effect will become $W_c'=h_2'-h_1=92.1-76.2=15.9$ BTU/lb $Q_i'=h_1-h_4'=76.2-33.5=42.7$ BTU/lb Thus by decreasing the condenser temperature by 20° F. the electrical energy required by the compressor has been reduced by $(h_2-h_2')/(h_2-h_1)=(17.9-15.9)/117.9=0.11$ or 11%

At the same time, the refrigeration effect has increased by $(h_4-h_4')/(h_1-h_4)=(42.7-37.7)/37.7=0.13$ or 13% The Coefficient of Performance of the refrigerator increased from $COP=(h_1-h_4)/(h_2-h_1)=37.7/17.9=2.11$ to $COP=(h_1-h_4')/(h_2'-h_1)=42.7/15.9=2.68$ an improvement of 27%

In other words, assuming that the outside air temperature is low enough so that the temperature of the condenser can be reduced from 130° F. (54.4 C.) to 110°F. (43.3C.), not only will the energy consumption of the refrigerator be significantly reduced, but its refrigeration capacity will be greatly increased, and its efficiency (COP) dramatically improved.

Figure 5:
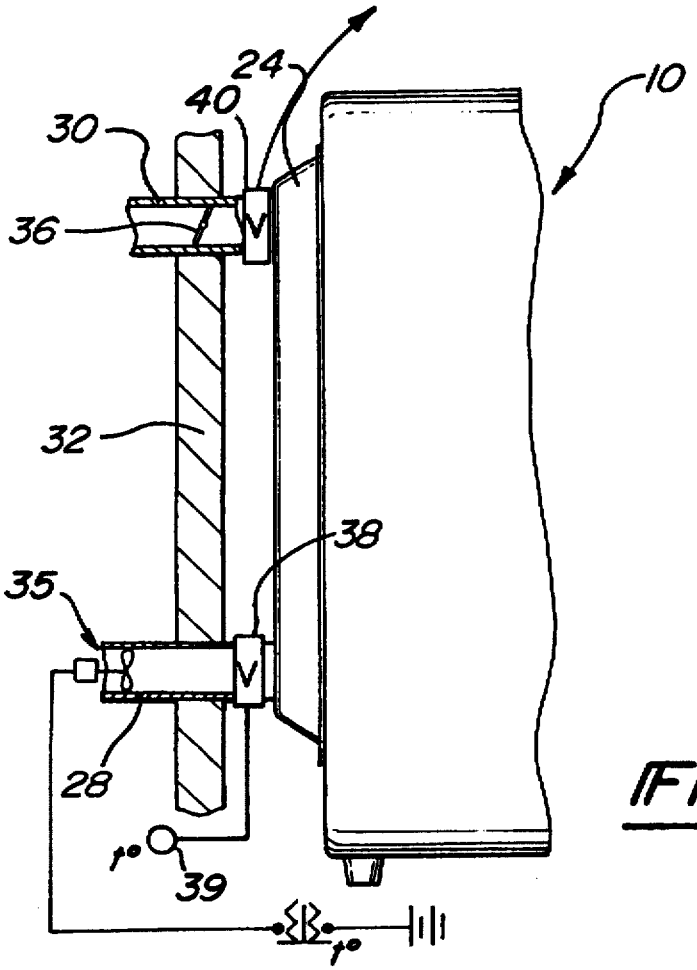
FIG. 5 is a side elevation view of a refrigerator according to a second embodiment of the present invention.

Thus, in accordance with the present invention, the fan 34 or 35 may be actuated when the outside air temperature drops to a predetermined threshold level (e.g. 80°, 26.7 C.). Alternatively, it should be appreciated that refrigerator 10 may already include a fan which may be used to divert some air flow into the compartment 24 from the outside. The energy transfer system 12 may also include a thermostatically actuated valve 38, such as the valve which would enable ambient air from inside the household to enter the compartment 24 when the outside air temperature is above a particular threshold level (e.g., 80° F., 26.7° C.). In this way, the compartment 24 will always be provided with a sufficient supply of air flow to cool the condenser 16. Likewise, as shown in FIG. 5, if the outside air temperature to is below a particular threshold level, ambient air from inside the household can be mixed with the outside air via valve 38. Valve 38 is provided with a temperature sensor 39 which detects when the outside temperature drops below the threshold temperature and opens the passage (i.e.

thermoactuated) to allow internal air to be mixed with the outside air. The mixing of ambient air from inside the household with cold outside air allows for an efficient transfer of heat from the condenser 16 without allowing components of the energy transfer system 12 to become too cold. Second conduit 30 may also be provided with a valve 40 which allows air outside air to be released within the house for providing fresh air inside the house. The outside air which enters through the first conduit 28 is warmed as it passes through the compartment 24 of household refrigeration appliance 10 and is released into the house as a means of providing fresh air into the house. Modern day houses are well insulted and nearly sealed airtight in order to keep out drafts and reduce heating costs. In such a well insulated home, circulation of fresh air within the home is sacrificed for heating efficiency unless some other means of introducing fresh air is introduced. The system of FIG. 5 provides an economical method for introducing fresh air into the home since the outside air is warmed by the heat generated by the refrigerator 10. Valve 40 may be opened manually when fresh air is desired within the household or can be controlled electronically to open periodically so that a supply of fresh air is introduced into house on a regular basis.

The present invention has been described in an illustrative manner. In this regard, it is evident that those skilled in the art once given the benefit of the foregoing disclosure, may now make modifications to the specific embodiments described herein without departing from the spirit of the present invention. Such modifications are to be considered within the scope of the present invention which is limited solely by the scope and spirit of the appended claims.

What is claimed is:

1. A refrigeration or freezer appliance comprising:

a housing surrounding a cooling storage compartment, a space being provided between said housing and cooling storage compartment;

refrigeration means for cooling said cooling storage compartment;

an inlet passage for communicating said space with an outside environment, said inlet passage provided with a valve for mixing air from inside a house with air from said outside environment;

an outlet passage for communicating said space with said outside environment, said outlet passage further comprises means for releasing air into said house; and means for drawing air into said inlet passage from said outside environment and into said space.

2. The appliance according to claim 1, wherein said valve provided in said inlet passage is thermoactuated when a temperature of said outside environment falls below a predetermined temperature.

* * * * *